United States Patent [19]

Weidler

[11] Patent Number: 4,579,413

[45] Date of Patent: Apr. 1, 1986

[54] CONNECTOR FOR THE MASS TERMINATION OF SMALL GAUGE MAGNET WIRE

[75] Inventor: Charles H. Weidler, Lancaster, Pa.

[73] Assignee: AMP Incorporated, Harrisburg, Pa.

[21] Appl. No.: 625,933

[22] Filed: Jun. 29, 1984

[51] Int. Cl.[4] ..... H01R 4/24

[52] U.S. Cl. ..... 339/99 R; 339/174

[58] Field of Search ..... 339/17 F, 95 R, 96, 339/97 R, 97 P, 98, 99 R, 174, 176 MF, 200 R

[56] References Cited

U.S. PATENT DOCUMENTS 4,074,929 2/1978 Krider ..... 339/221 R 4,087,146 5/1978 Hudson, Jr. ..... 339/17 F

FOREIGN PATENT DOCUMENTS 1425477 2/1976 United Kingdom ..... 339/99 R

*Primary Examiner*—Neil Abrams

*Attorney, Agent, or Firm*—Robert W. J. Usher

[57] ABSTRACT

An electrical connector assembly for the mass termination of magnet wires including a series of terminals each constituted by a one-piece, stamped and formed, metal strip with a convex, serrated, wire engaging tongue and a contact portion joined by a bight. A housing base has wire receiving compartments receiving the tongues and a closure member comprises a series of ribs with concave wire engaging surfaces. Complementary latching means are provided on the closure member and base interengageable to maintain the rib surfaces in the compartments pressing wires against the serrations on the wire engaging tongues to effect multiple electrical connection with the wires.

6 Claims, 3 Drawing Figures

CONNECTOR FOR THE MASS TERMINATION OF SMALL GAUGE MAGNET WIRE

The invention relates to an electrical connector for terminating fine wires, for example magnet wires and, in particular, for terminating magnet wires of small gauge.

Magnet wires are fine wires having a single strand core covered by a thin layer of insulation such as varnish. Magnet wires of small gauge may have a core diameter as small as 0.0015 inches.

Various proposals have been made for terminating magnet wires with coil windings on stator housings, in particular, as exemplified in U.S. Pat. No. 4,130,331 and 4,118,103 in which a wire is located across a gap in a cavity in an inslating housing formed integrally with the stator housing and a terminal having an open slot is inserted into the cavity so that opposite walls of the slot straddle the wire and penetrate the insulation to establish permanent electrical connection to the core. Tangs are provided on the terminal to engage the housing cavity wall during insertion into the housing to retain the terminal in the cavity terminating the wire.

However, a disadvantage of these prior proposals is that the walls or edges of the sot only effect connection to a relatively small area of wire core, i.e., at a single axial location on the wire. Furthermore, difficulties have been experienced in extending this technique to magnet wires of small gauge in view of their fragility.

One development of this technique is taught in U.S. Pat. No. 4,183,607 in which a wire supporting stuffer is received in the wire connecting slot itself in addition to the wire with the result that the wire is jammed between the wall of the stuffer and the slot wall.

Whilst this provides increased support for the wire during termination, connection is effected to only one side of the wire and the risk of severing the wire as a result of too large manufacturing tolerances remains.

In yet another proposal, terminals having substantially closed slots formed by shearing are used in an attempt to effect connection to the small gauge magnet wires. However, the last-mentioned proposal has still not been entirely satisfactory with the smallest gauge magnet wires having diameters of about 0.0015 inches.

In summary, all the above-mentioned proposals require the manipulation of very small parts with insulating houses moulded to very close tolerances while only a very small contact area is achieved. In view of the axial movement of the slot wall or edge transversely of the wire, there remains a risk of severing the wire if the tolerances are not met both in the parts and in the assembly tooling.

U.S. Pat. No. 4,026,013 describes another proposal which attempts to effect multiple connections to a magnet wire axially of its length by pressing the wire between the wall of a housing and a serrated wire engaging surface of a contact. However, the contact force is provided by deformation of the contact from a generally parallelogram configuration to a rectangular configuration during insertion of the contact into the housing by engagement of a leading corner of the contact with an end wall of the housing. This has not proved entirely satisfactory with the small gauge magnet wires in view of the relative movement and substantial forces are transmitted to the insulating housing which may cause damage thereto.

An object of the invention is to provide a connector for terminating small gauge magnet wire which connector is economical to manufacture and assemble by conventional mass production techniques, and which makes multiple connections with the wire along its length without risk of breaking the wire.

There is also a requirement to mass terminate the magnet wires simultaneously, particularly for flat circuit applications such as printed circuit board applications.

None of the above-mentioned approaches is suitable for adaptation to mass production in view of the high degree of precision that each requires and, in the last mentioned proposal, the multiple high forces transmitted to the housing.

According to the invention, there is provided an electrical connector assembly for the mass termination of magnet wires comprising a series of terminals mounted in a housing comprising a base member and a closure member, each terminal comprising a one-piece stamped and formed metal strip reversely bent to define an elongate wire engaging tongue and an elongate contact portion extending from respective opposite ends of a bight, the wire engaging tongue being arcuate providing a convex, outwardly facing, wire engaging surface having a series of transverse serrations, the housing base member comprising a body with upper and lower faces, a series of partitions upstanding in spaced parallel relation from the upper face defining between them wire receiving compartments, the tongues being received in the compartments spaced from the upper surface of the body which is received as an interference fit in the bight, wire locating recesses being formed in one side of the housing base aligned centrally of the wire engaging portions and wire securing means on the other side of the housing; the closure member comprising a series of ribs in spaced apart, parallel, relation having concave wire engaging surfaces aligned with the compartments; complementary latching means provided in the closure member and base interengageable to latch the closure member to the base with the wire engaging surfaces of the ribs received in the compartments pressing wires extending between the wire securing member and the notches against the wire engaging surfaces of the wire engaging tongues with resilient deformation of the terminals so that the serrations penetrate the insulation to effect multiple connections along the length of the wire.

In use of the invention, all the wires can be preloaded into the base and than terminated simply by the application of the closure member to the base with the wire engaging surfaces moved perpendicularly together. The use of relatively wide wire connecting tongues obviates any need for closely held tolerances and their resilience ensures that a good connection be obtained and maintained while the closure member is latched to the base. The latch means may assist in guiding the closure member perpendicularly towards the base to avoid any relative longitudinal or lateral movement between the wires and the wire engaging surfaces.

More particularly, the latch means comprises a pair of spaced latching shoulders undercut relative to the ends of the body to provide a dovetail configuration and a pair of bifurcated latch arms extending from respective opposite ends of the closure member having latch heads with surfaces tapering both towards their free ends and away from the body complementary to the dovetail whereby interengagement of the latching means maintains the latching arms adjacent the body.

In one embodiment, the contact portions are received in grooves extending along the lower face of the body in communication with the compartments at the bight.

Preferably, the wire securing means comprises a double-sided adhesive strip bridging the upper surfaces of the support.

Desirably, the free ends of the contact portions are bent inwardly to grip the other side of the body at one end of the ends.

An example of an electrical connector assembly according to the invention will now be described with reference to the accompanying drawings in which.

Figure 1:
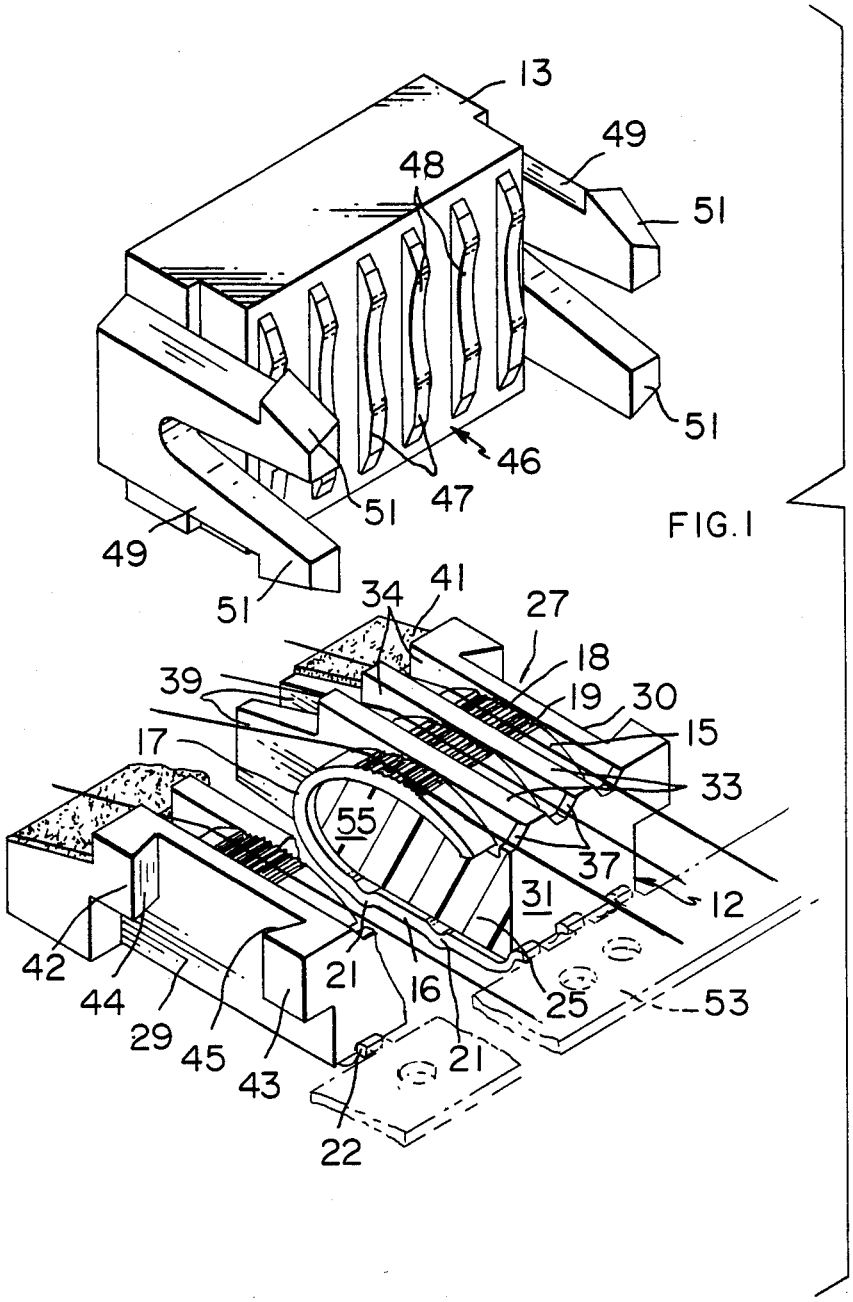
FIG. 1 is an exploded perspective view, partly in cross-section, of the connector assembly.
Figure 3:
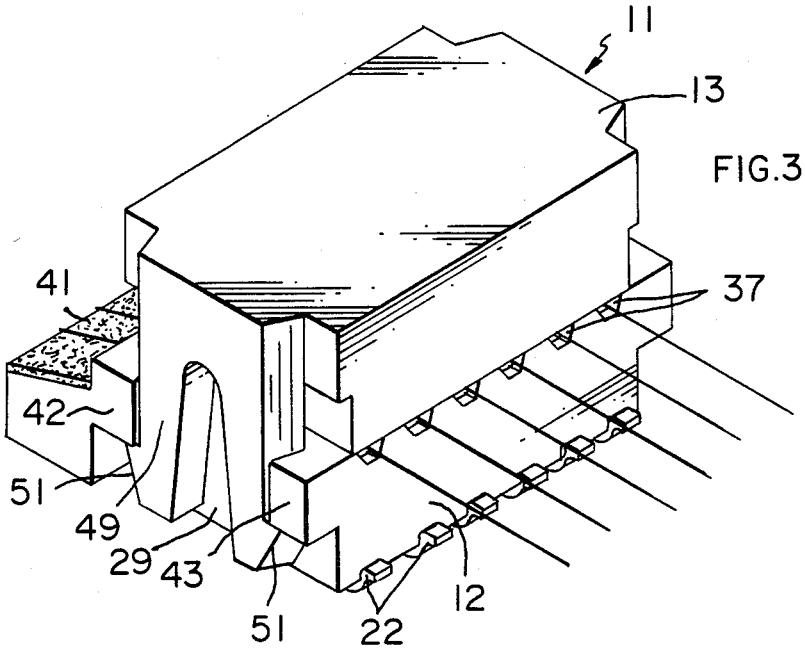
FIG. 3 is a perspective view of the assembly.
Figure 2:
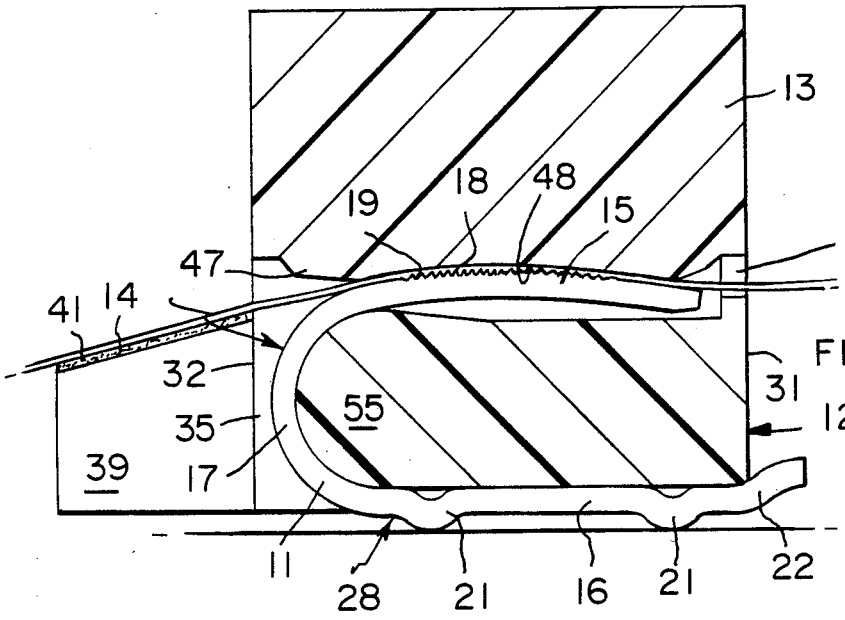
FIG. 2 is a cross-sectional view of the assembly.

The electrical connector assembly comprises an insulating housing 11 consisting of a base member 12 and a closure member 13 and a series of terminals 14 mounted on the base member. Each terminal 14 comprises a one-piece, stamped and formed, metal strip reversely bent to form an elongate wire engaging tongue 15 and an elongate board contacting portion 16 extending from opposite ends of a bight 17. The wire engaging tongue 15 is arcuate, providing a convex, outwardly facing, wire engaging surface 18 having a series of transversely extending, insulation penetrating serrations 19. The board contacting portion 16 is generally flat with a pair of longitudinally spaced contact protuberances 21 pushed outwardly of the strip. The free end of the board contacting portion is bent inwardly to provide a base gripping finger 22.

The housing base 12 comprises a body 25 with upper and lower faces 27 and 28, respectively; ends 29 and 30; and first and second sides 31 and 32, respectively. A series of partitions 33 outstand from the upper face in spaced apart relation defining between them wire receiving compartments 34 and terminal locating grooves 35 extend down the second side 32 and along the lower face 28. The first side 31 of the base if formed with a series of wire locating notches 37 aligned centrally of respective compartments. A series of spaced supports 39 extend from the second side 32 of the base in alignment with respective partitions supporting a double-sided adhesive tape 41 extending between the ends of the body.

Latching shoulders 42, 43, respectively, are located in spaced relation adjacent the upper face at respective first and second sides and opposed surfaces 44, 45 of the shoulders are undercut relative to the ends of the body to provide a dovetail configuration.

The closure member 13 has a wire engaging face 46 formed with a series of outstanding spaced parallel ribs 47 having concave surfaces 48 of complementary shape to the wire engaging surfaces 18 of the terminals. Bifurcated latch arms 49 depend from respective opposite ends of the closure member 13 and have latch heads 51 respectively of complementary tapering shape to the faces 44, 45.

A series of terminals integrally joined to a carrier strip 53 (indicated in broken lines in FIG. 1) is mounted on the body 12 with the body portions between the partitions 33 received in the terminal bight 17 in an interference fit, the body being enlarged at 55 for this purpose and to provide clearance for the wire engaging tongue 15. The carrier strip 53 is then removed. The adhesive tape can be applied to the supports before or after the mounting of the terminals on the body.

In use of the connector assembly to mass terminate small gauge magnet wires, the wires are drawn into the compartments to lie longitudinally along the wire engaging surfaces 18 of the respective terminals guided by the notches 37 and the wire ends received by adhesion to the tape 41. The closure member 13 is then applied to the base 12 so that the latching arms engage the shoulders which assists in guiding the closure member perpendicularly towards the base, the dovetail configuration preventing splay. In the latching condition, the surfaces 48 of the ribs will press the wires against the wire engaging surfaces 18 of the terminals with substantially no relative longitudinal or lateral movement causing the serrations to penetrate the insulation to establish multiple connections along the lengths of the wires and maintaining the terminals in flexed condition. The connector assembly may be mounted on a flat circuit such as a printed circuit board or a flat, flexible cable prior to or after termination.

Should it be desired to replace a single wire, removal of the closure member and replacement should be possible without significant damage to the other wires.

It will be appreciated that the mass termination can be effected rapidly using the assembly parts which can be produced economically using mass production techniques. The need for maintenance of the very close tolerances of the prior art proposals is avoided and there is no requirement for complex termination or assembly tooling as these procedures can even be carried out manually if desired.

Wire retaining means such as winding posts can be used to replace the adhesive strip if desired.

What is claimed is:

1. An electrical connector assembly for the mass termination of small gauge magnet wires comprising a series of terminals mounted in a housing comprising a base member and a closure member, each terminal comprising a one-piece stamped and formed metal strip reversely bent to define a resilient elongate wire engaging tongue and an elongate contact portion extending from respective opposite ends of a bight, the wire engaging tongue being arcuate providing a convex, outwardly facing, wire engaging surface broad relative to the wire and having a series of transverse serrations, the housing base member comprising a body with upper and lower faces, a series of partitions upstanding in spaced parallel relation from the upper face defining between them wire receiving compartments and terminal locating grooves extending along the lower face communicating with the compartments, the tongues being received in the compartments spaced from the upper surface of the body which is received as an interference fit in the bight, wire locating recesses being formed in one side of the housing base aligned centrally of the wire engaging portions and wire securing means on the other side of the housing;

the closure member comprising a series of ribs in spaced apart parallel relation having wire engaging surfaces aligned with the compartments;

complementary latching means provide in the closure member and base interengageable to latch the closure member to the base with the wire engaging surfaces of the ribs received in the compartments pressing wires extending between the wire securing means and the recesses against the wire engaging surfaces of the wire engaging tongues with resilient deformation of the terminals so that the serrations penetrate the insulation to effect multiple connections along the length of the wire.

2. A electrical connector according to claim 1 in which the wire securing means comprises a double-sided adhesive strip bridging the upper surfaces of the support.

3. An electrical connector according to claim 1 in which the free ends of the contact portions are bent inwardly to grip the other side of the body at one end of the ends.

4. A electrical connector according to claim 1 in which the latch means comprises a pair of spaced latching shoulders undercut relative to the ends of the body to provide a dovetail configuration and a pair of bifurcated latch arms extending from respective opposite ends of the closure member having latch heads with surfaces tapering both towards their free ends and away from the body complementary to the dovetail whereby interengagement of the latching means maintains the latching arms adjacent the body.

5. An electrical connector according to claim 2 in which adhesive tape is mounted to extend transversely of a series of supports protruding from the other side of the housing in alignment with the partitions.

6. An electrical connector according to claim 1 in which the contact portions are received in grooves extending along the lower face of the body in communication with the compartments at the bight.

* * * * *